US006330803B1

(12) United States Patent
Shin

(10) Patent No.: US 6,330,803 B1
(45) Date of Patent: Dec. 18, 2001

(54) OPERATION CONTROL APPARATUS FOR A REFRIGERATOR

(75) Inventor: Kyu-Ho Shin, Kwangju (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/525,032

(22) Filed: Mar. 14, 2000

(30) Foreign Application Priority Data

Dec. 27, 1999 (KR) ..... 99-62740

(51) Int. Cl.[7] ..... F25D 17/06

(52) U.S. Cl. ..... 62/156; 62/179; 62/180; 62/442

(58) Field of Search ..... 62/179, 180, 186, 62/229, 442, 151, 156, 203, 275, 276

(56) References Cited

U.S. PATENT DOCUMENTS 3,218,819 * 11/1965 Crotser ..... 62/442 X
5,720,180 * 2/1998 Suh ..... 62/179
5,722,248 3/1998 Suh .
5,771,701 * 6/1998 Suh ..... 62/229 X
5,778,688 7/1998 Park et al. .

* cited by examiner

*Primary Examiner*—Harry B. Tanner
(74) *Attorney, Agent, or Firm*—Larson & Taylor PLC

(57) ABSTRACT

An operation control apparatus for a refrigerator performs a cooling operation by using a refrigerating compartment temperature regulator directly connected to a power-supply input terminal even if a freezing compartment temperature regulator is turned off, thereby effectively restricting an increase of the inside temperature of the refrigerating compartment. In an operation control apparatus for a refrigerator which includes a freezing compartment temperature regulator for setting a freezing compartment temperature to a predetermined temperature and a refrigerating compartment temperature regulator for setting a refrigerating compartment temperature to a predetermined temperature, the freezing compartment temperature regulator is serially connected to the freezing compartment fan motor, the refrigerating compartment temperature regulator is serially connected to the refrigerating compartment fan motor, and the serially connected refrigerating compartment temperature regulator and refrigerating compartment fan motor and the serially connected freezing compartment temperature regulator and freezing compartment fan motor are connected in parallel to an input terminal of a power-supply.

3 Claims, 5 Drawing Sheets

OPERATION CONTROL APPARATUS FOR A REFRIGERATOR

FIELD OF THE INVENTION

The present invention relates to an operation control apparatus for a refrigerator. More particularly, it relates to an operation control apparatus for a refrigerator which performs a cooling operation by using a refrigerating compartment temperature regulator which is directly connected to a power-supply input terminal so that even if a freezing compartment temperature regulator is turned off, a cooling operation of the refrigerating compartment continues thereby effectively restricting an increase of the inside temperature of a refrigerating compartment.

BACKGROUND OF THE INVENTION

Conventionally, a refrigerator includes a storage chamber for storing the food therein. The refrigerator regulates a compartment inside temperature by using a cooling cycle apparatus (comprised of a compressor, condenser, capillary tube, and evaporator), and stores the foodstuffs received in the compartment to keep the foodstuffs fresh for a long time.

In recent times, following the trend for large-sized storage compartments for storing great quantities of foodstuffs, a refrigerator having such a large-sized storage chamber is well known in the art. Such a refrigerator includes a freezing compartment as well as the refrigerating compartment with a large capacity. The refrigerator further includes a plurality of evaporators and fans, and thus respectively provides cool air to the freezing and refrigerating compartments.

In such a conventional refrigerator, the freezing compartment and the refrigerating compartment are separated from each other. An evaporator and fan are mounted on a rear wall of the freezing compartment, and another evaporator and another fan are mounted to a rear wall of the refrigerating compartment.

Referring to a conventional large-size refrigerator depicted in FIG. 1, a compressor 27 is connected in series to a freezing compartment temperature regulator 10 and a defrosting timer 11. A starting condenser C1 connected to a front end of the compressor 27 provides a starting current from a power-supply. An operation condenser C2 provides an operation current after a starting operation. A positive temperature coefficient (PTC) relay 26 provides a starting current to the compressor 27. An overload relay 28 prevents an abnormal temperature rising and overcurrent of the compressor 27. A compressor cooling fan motor 25 adjacent to the compressor 27 is driven with the compressor 27 in order to circulate outside air and hence to cool the compressor 27.

A first terminal al of the defrosting timer 11 is connected to a freezing compartment fan motor 21 and a refrigerating compartment temperature regulator 22. A refrigerating compartment fan motor 24 is connected to a first terminal b1 of the refrigerating compartment temperature regulator 22. The freezing compartment fan motor 21 and the refrigerating compartment fan motor 24 respectively circulate cool air generated by the freezing compartment evaporator and the refrigerating compartment evaporator respectively to the freezing compartment and the refrigerating compartment.

A second terminal b2 of the refrigerating compartment temperature regulator 22 is connected to a metal heater 23. The metal heater 23 generates a slight heat. By this slight heat, the temperature regulator 22 is compensated a peripheral low temperature.

A door switch 20 is directly connected to a power-supply input terminal AC. The door switch 20 turns on a first lamp 18 when opening a refrigerating compartment door, and turns on a second lamp 19 when opening a freezing compartment door. The door switch 20 cuts off power applied to the fan motors 21 and 24 simultaneously with the turning on of the lamps 18 and 19.

In a defrosting operation, a synchronous motor M1 of a defrosting timer 11 is driven, and thus the synchronous motor M1 is connected to the second terminal a2. A first defrosting heater 14 serially connected to a first temperature fuse 13 and a second defrosting heater 17 serially connected to a second temperature fuse 16 generate heat. A first bimetal thermostat 12 is connected to the first temperature fuse 13. A second bimetal thermostat 15 is connected to the second temperature fuse 16. These thermostats 12 and 15 sense a surface temperature of a freezing compartment evaporator and of a refrigerating compartment evaporator. If the first and second bimetal thermostats 12 and 15 are turned off because they arrive at a defrosting release temperature, power is cut off so that the defrosting operation of the first defrosting heater 14 and the second defrosting heater 17 is terminated.

In the aforementioned refrigerator, the refrigerating compartment temperature regulator 22 for controlling the refrigerating compartment temperature is dependent upon the freezing compartment temperature regulator 10. Therefore, cooling of the refrigerating compartment is not achieved even if the refrigerating compartment temperature is high when the freezing compartment temperature regulator 10 is turned off.

Referring to FIG. 2, in the case where a refrigerator is initially driven after receiving power from a power-supply, the temperatures of the freezing and refrigerating compartments are higher than each set temperature. At this time, under the condition that the freezing compartment temperature regulator 10 is connected to the first terminal b1 and that the defrosting timer 11 is connected to the first terminal a1 so that the compressor 27 and the freezing compartment fan motor 21 are driven, cool air generated by the freezing compartment evaporator is circulated toward the inside of the freezing compartment. In addition, with the refrigerating compartment temperature regulator 22 connected to the first terminal b1, cool air generated by the refrigerating compartment evaporator is circulated toward the inside of the refrigerating compartment.

If the freezing compartment temperature is below the freezing compartment set temperature while performing a cooling operation for each compartment, the freezing compartment temperature regulator 10 goes to an off state so that the power is cut off, and therefore the compressor 27 and the freezing compartment fan motor 21 are turned off. In a period R1 wherein a cooling operation is still required because a temperature of the refrigerating compartment is still higher than the refrigerating compartment set temperature, the refrigerating compartment temperature regulator 22 is connected to the first terminal b1. However, with the power cut off, the refrigerating compartment fan motor 24 is stopped. As a result, further circulation of cool air toward the inside of the refrigerating compartment is stopped, so that the cooling operation of the refrigerating compartment is inefficiently effected.

If a defrosting operation starts, a defrosting timer 11 is connected to the second terminal a2 by a driving of the synchronous motor M1. The first and second defrosting heaters 14 and 17 are then driven so that a defrosting operation is performed to remove frost formed on the freezing compartment evaporator.

If the defrosting operation is terminated, the defrosting timer 11 is connected to the first terminal a1 by a driving of the synchronous motor M1. This results in the compressor 27 and the freezing compartment fan motor 21 being driven, cool air being applied to the freezing compartment, and a cooling operation of the freezing compartment being performed. At this time, if a refrigerating compartment temperature regulator 22 is connected to the first terminal b1, the refrigerating compartment fan motor 24 is driven so that a cooling operation of the refrigerating compartment is performed.

When a temperature of the freezing compartment becomes lower than the freezing compartment set temperature while performing the cooling operation of the freezing compartment, the freezing compartment temperature regulator 10 is changed to an off state and the power is cut off. Therefore, the compressor 27 and the freezing compartment fan motor 21 are stopped and the refrigerating compartment fan motor 24 cannot be driven. In this case, if the refrigerating compartment temperature maintains a proper temperature, there is no problem with the cooling operation of the refrigerating compartment. However, if the refrigerating compartment temperature is higher than the refrigerating compartment set temperature (for example, where food is initially stored in the refrigerating compartment), in the period R2 wherein a cooling operation of the refrigerating compartment is required, the refrigerating compartment temperature regulator 22 is connected to the first terminal b1 but the refrigerating compartment fan motor 24 is without power. This results in an inefficient cooling operation of the refrigerating compartment.

As described above, in the conventional refrigerator, driving of the refrigerating compartment fan motor is determined by the freezing compartment temperature regulator which is turned on or off in response to the temperature of the freezing compartment. Thus, the cooling operation of the refrigerating compartment is dependent upon the cooling operation of the freezing compartment, which results in: an inefficient cooling operation of the refrigerating compartment, a higher than desired temperature of the refrigerating compartment, an increase in the total time required for a cooling operation of the refrigerating compartment, and a decreasing operation efficiency.

BRIEF SUMMARY OF THE INVENTION

Accordingly, the present invention is directed to an operation control apparatus for a refrigerator that substantially obviates one or more of the problems due to the limitations and disadvantages of the noted prior art.

It is an objective of the present invention to provide an operation control apparatus for a refrigerator which independently performs a cooling operation of the refrigerating compartment without regard to a cooling operation of the freezing compartment.

To achieve the above objectives, the operation control apparatus for a refrigerator of the present invention is provided. The refrigerator includes a freezing compartment evaporator and a freezing compartment fan motor mounted in a freezing compartment, a refrigerating compartment evaporator and a refrigerating compartment fan motor mounted in a refrigerating compartment, and a freezing compartment temperature regulator for setting a freezing compartment temperature to a predetermined temperature and a refrigerating compartment temperature regulator for setting a refrigerating compartment temperature to a predetermined temperature. The freezing compartment temperature regulator is serially connected to the freezing compartment fan motor, and the refrigerating compartment temperature regulator is serially connected to the refrigerating compartment fan motor,. In addition, the serially connected refrigerating compartment temperature regulator and refrigerating compartment fan motor and the serially connected freezing compartment temperature regulator and freezing compartment fan motor are connected in parallel to an input terminal of a power-supply.

The freezing compartment temperature regulator and the freezing compartment fan motor are also serially connected to a compressor, and the refrigerating compartment temperature regulator and the refrigerating compartment fan motor are connected in parallel to the compressor.

A bimetal thermostat is mounted adjacent to a defrosting heater mounted on the refrigerating compartment evaporator. This bimetal thermostat is serially connected to the refrigerating compartment fan motor, and is thus operated to turn off the refrigerating compartment fan motor after a defrosting operation.

BRIEF DESCRIPTION OF THE SEVERAL VIEWS OF THE DRAWINGS

Further objects and other advantages of the present invention will become apparent from the following description in conjunction with the attached drawings, in which.

DETAILED DESCRIPTION OF THE INVENTION

The preferred embodiments of the present invention will now be described in detail with reference to the accompanying drawings.

Figure 1:
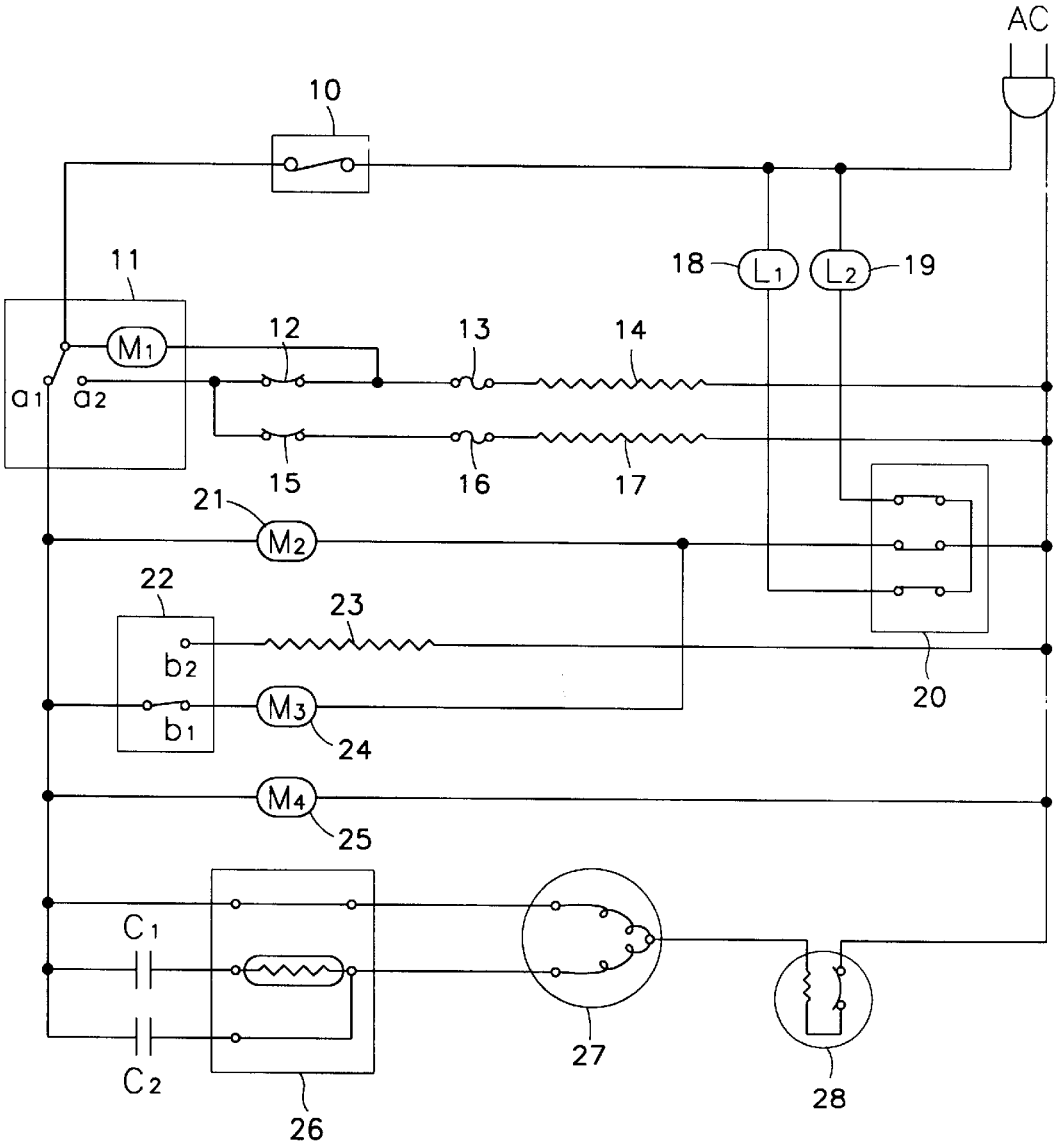
FIG. 1 (PRIOR ART)
FIG. 1 is a circuit diagram of an operation control apparatus of a conventional refrigerator.
Figure 2:
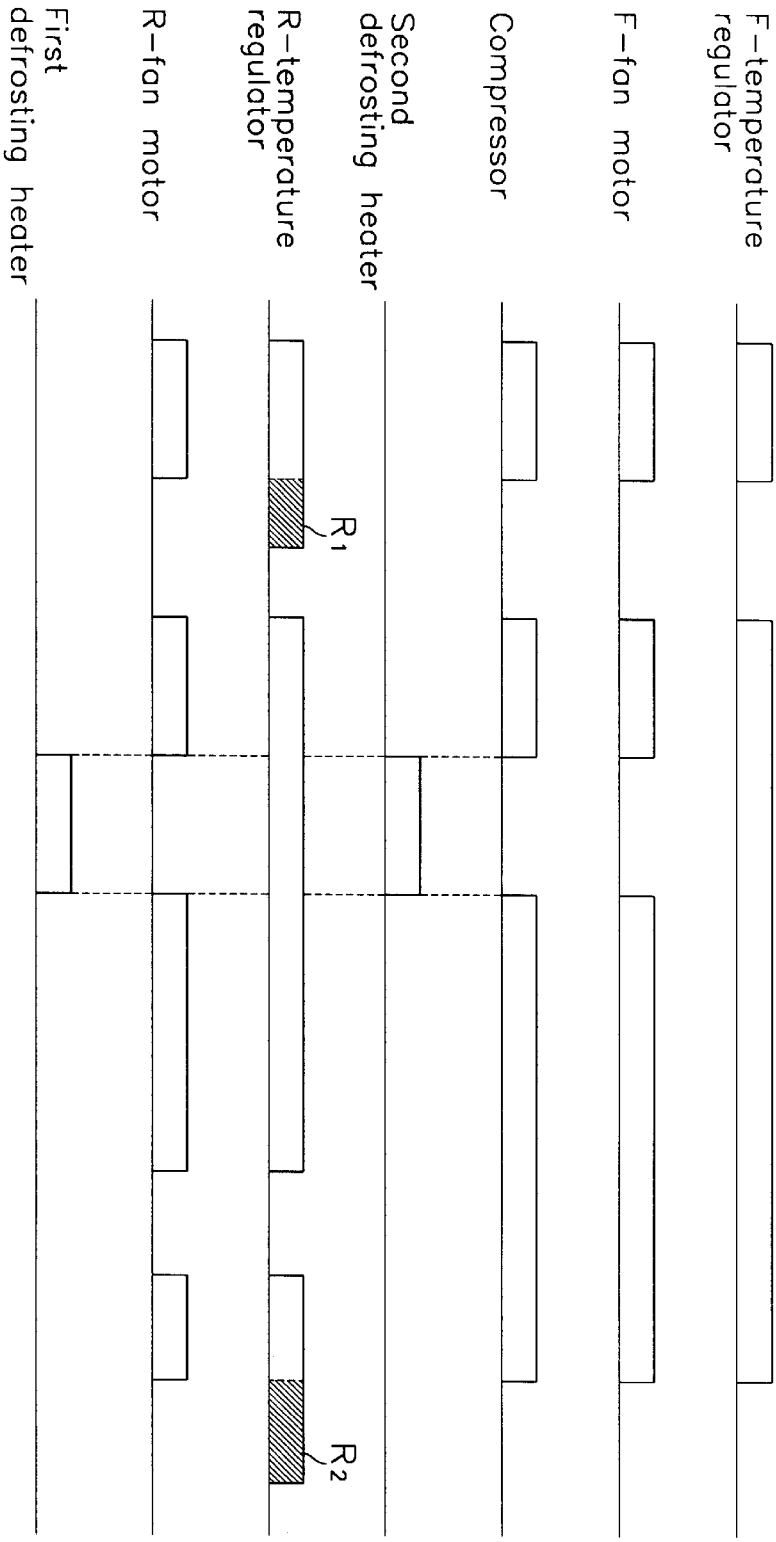
FIG. 2 (PRIOR ART)
FIG. 2 is a timing chart showing an operation of each part of the conventional refrigerator.
Figure 3:
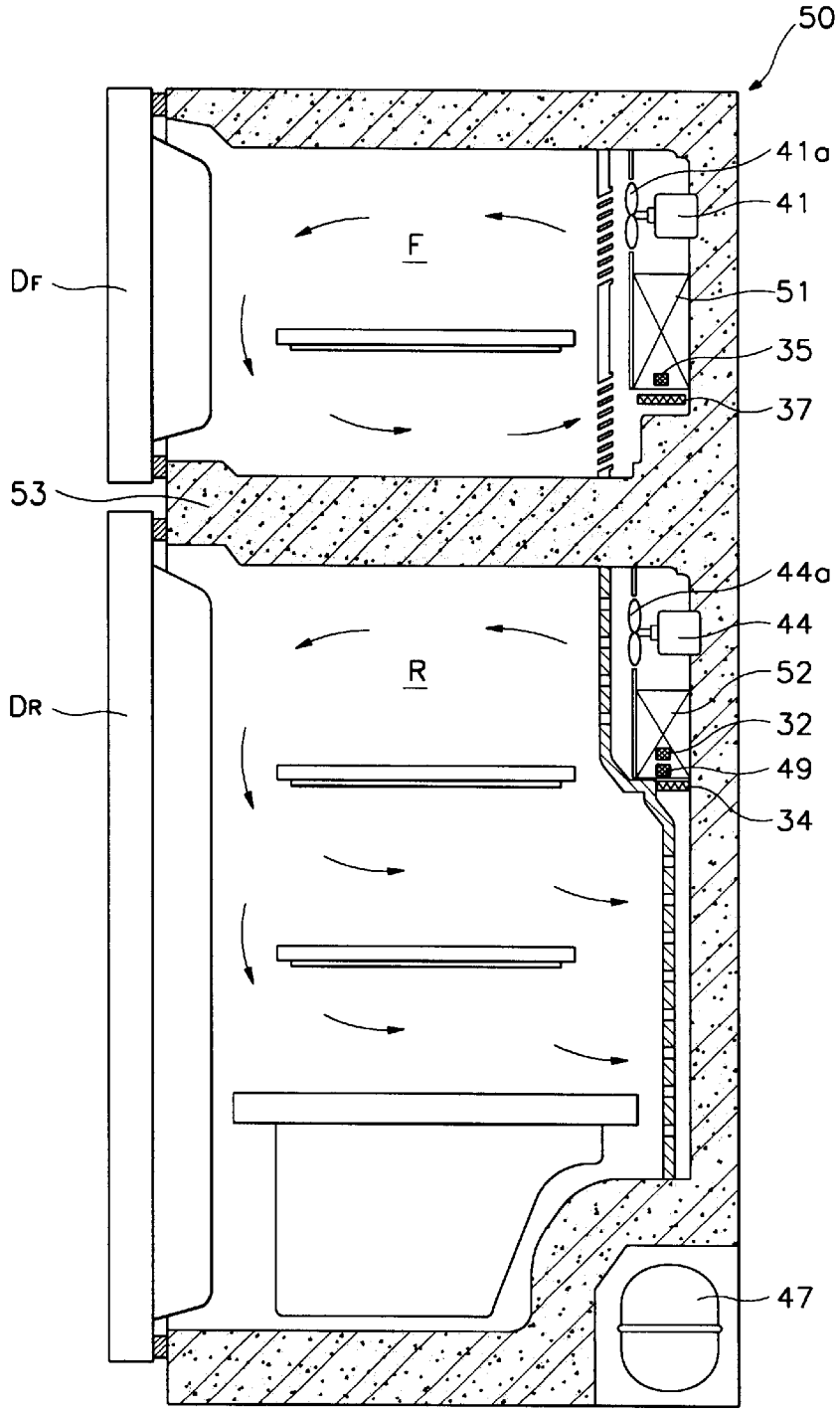
FIG. 3 is a schematic cross-section elevation view of an internal structure of a refrigerator according to the present invention.

Referring to FIG. 3, the refrigerator according to the present invention provides a freezing compartment F and a refrigerating compartment R in the main body 50. The freezing compartment F and the refrigerating compartment R are separated from each other by a central wall 53. A freezing compartment evaporator 51, a freezing compartment fan motor 41, and a freezing compartment fan 41*a* are mounted in the rear of the freezing compartment F. A refrigerating compartment evaporator 52, a refrigerating compartment fan motor 44 and a refrigerating compartment fan 44*a* are mounted in the rear of the refrigerating compartment R.

The freezing compartment fan motor 41 rotates the freezing compartment fan 41*a* at a predetermined speed during a cooling operation of the freezing compartment F, and circulates cool air into the freezing compartment F. Independently of the cooling operation of the freezing compartment F, the refrigerating compartment fan motor 44 rotates the refrigerating compartment fan 44*a* at a predetermined speed during a cooling operation of the refrigerating compartment R, and circulates cool air into the refrigerating compartment R.

A compressor 47 is provided in a lower part of the main body 50. A freezing compartment door Df is rotatably mounted to the freezing compartment F, and a refrigerating compartment door Dr is rotatably mounted to the refrigerating compartment R.

A second defrosting heater 37 for removing frost from the freezing compartment evaporator 51 is provided in the lower part of the freezing compartment F. A second bimetal thermostat 35 for turning off the second defrosting heater 37 during a defrosting operation of the freezing compartment F is mounted in the inside of the freezing compartment evaporator 51.

A first defrosting heater 34 for removing frost from the refrigerating compartment evaporator 52 is provided in a lower part of the refrigerating compartment R. A first bimetal thermostat 32 for turning off the first defrosting heater 34 during a defrosting operation of the refrigerating compartment is mounted in the refrigerating compartment evaporator 52. A third bimetal thermostat 49 for turning off the refrigerating compartment fan motor 44 at the initiation of a defrosting operation is located adjacent to the first defrosting heater 34, and is mounted to a surface of the evaporator 52. In operation, the compressor 47 is turned off during the defrosting operation of the refrigerating compartment R, the first defrosting heater 34 is driven so that a surface temperature of the evaporator 52 reaches a predetermined operation temperature (about 12° C.), and then the third bimetal thermostat 49 is turned off. The third bimetal thermostat 49 is turned off if a peripheral temperature of the first thermostat 32 reaches a defrosting release temperature (about 12° C.), which occurs when frost formed on the evaporator 52 is completely removed due to the heat of the first defrosting heater 34.

Thus, if a predetermined time (e.g., several seconds) elapses after starting the defrosting operation of the refrigerating compartment, (with the first bimetal thermostat 32 positioned in the evaporator 52 and with the third bimetal thermostat 49 adjacent to the first defrosting heater 34) and the third bimetal thermostat 49 is turned off, the refrigerating compartment fan motor 44 stops operating due to the cut-off of the third bimetal thermostat 49. Then, after some predetermined time elapses, the peripheral temperature of the first thermostat 32 rises to the defrosting release temperature (about 12° C.) because of the heater's heat, so that the first bimetal thermostat 32 is turned off. Finally, after the compressor 47 is again driven, the peripheral temperature of the first thermostat 32 falls so that the third bimetal thermostat 49 is changed to an on-state.

A freezing compartment temperature regulator (e.g. F-thermostat 30) is provided in the freezing compartment F. A refrigerating compartment temperature regulator (e.g. R-thermostat 42) is provided into the refrigerating compartment R.

By using the temperature regulators, the user can set a desired temperature among a plurality of temperature levels. For example, in the case where five temperature levels are provided, they are configured as follows: the coldest temperature level is 'STRONG', a middle temperature level is 'MIDDLE', a high temperature level is 'WEAK', a relative low temperature level is 'STRONG-MIDDLE', and a relative high temperature level is 'MIDDLE-WEAK'. If the user rotates a regulation switch of a dial of the regulator in view of a quantity of a storage food in the refrigerator, a temperature regulator connected to the regulation switch sets a predetermined temperature corresponding to a user-desired temperature level among the five temperature levels. This temperature regulator can be embodied as a thermostat.

Figure 4:
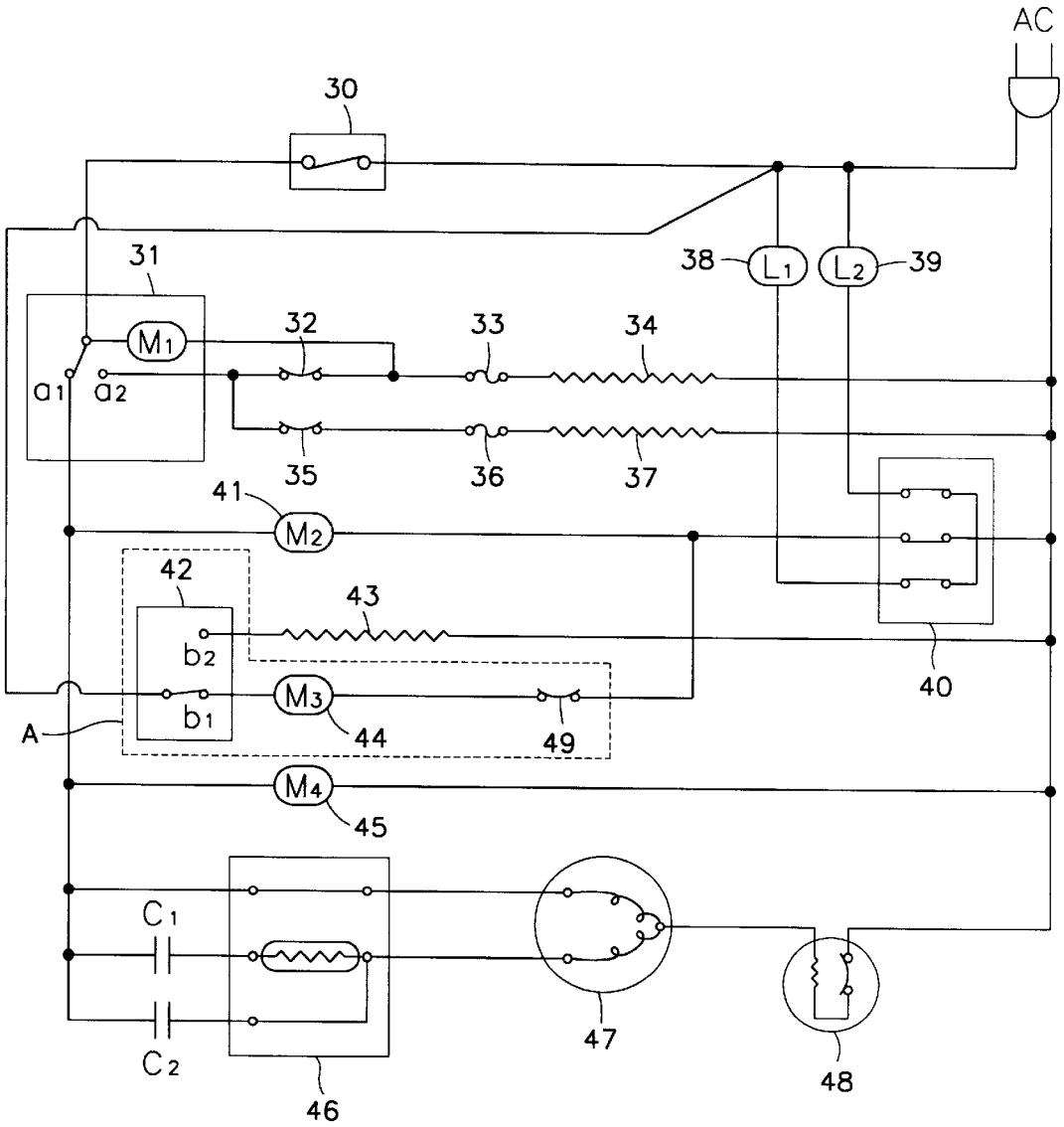
FIG. 4 is a circuit diagram of an operation control apparatus of a refrigerator according to the present invention.

FIG. 4 is a circuit diagram of an operation control apparatus of a refrigerator according to the present invention.

In order to perform a cooling operation about the freezing and refrigerating compartments, the compressor 47 is connected in series to a freezing compartment temperature regulator 30 (hereinafter referred to as F-thermostat) and a defrosting timer 31. If the F-thermostat 30 is turned on because a freezing compartment temperature is higher than a freezing set temperature, power is provided from a power-supply input terminal AC. A starting condenser C1 connected to a front end of the compressor 47 provides a starting current when provided with power. An operation condenser C2 provides an operation current after a starting operation. A positive temperature coefficient (PTC) relay 46 provides a starting current to the compressor 47. An overload relay 48 prevents an abnormal temperature rising and overcurrent of the compressor 47. A compressor cooling fan motor 45 adjacent to the compressor 47 is driven with the compressor 47 in order to circulate outside air and hence to cool the compressor 47.

When the compressor 47 is driven as described, the defrosting timer 31 is connected to a first terminal a1. The freezing compartment fan motor 41 is also connected to the first terminal a1, such that the freezing compartment fan motor 41 is driven together with the compressor 47 and causes the freezing compartment fan 44a to be rotated with a predetermined speed. Accordingly, cool air generated by the freezing compartment evaporator 51 is circulated into the freezing compartment, causing the freezing compartment temperature to be lowered.

An electric circuit A is also provided to cool the refrigerating compartment without regard to the cooling operation of the freezing compartment. The electric circuit A includes a refrigerating compartment temperature regulator (hereinafter referred to as R-thermostat) 42, the refrigerating compartment fan motor 44, and the third bimetal thermostat 49. The R-thermostat 42 is directly connected to the power-supply input terminal AC. The R-thermostat 42, the refrigerating compartment fan motor 44 and the third bimetal thermostat 49 are connected in series to each other. If the power is cut off by the R-thermostat 42 or by the third bimetal thermostat 49, the refrigerating compartment fan motor 44 is turned off.

Since the R-thermostat 42 directly receives power from the power-supply input terminal AC as an input, the R-thermostat 42 is independently operated from the operation of the F-thermostat 30, and it is connected to either a first terminal b1 or a second terminal b2 according to the refrigerating compartment temperature.

If the R-thermostat 42 is connected to the first terminal b1 because the refrigerating compartment temperature is higher than a refrigerating compartment set temperature, the refrigerating compartment fan motor 44 rotates the refrigerating compartment fan 44*a* with a predetermined speed, so that cool air generated by the refrigerating compartment evaporator 52 is circulated into the refrigerating compartment, thereby performing a cooling operation.

If the refrigerating compartment temperature is not higher than the refrigerating compartment set temperature, the R-thermostat 42 is connected to the second terminal b2, so that the refrigerating compartment fan motor 44 is stopped and the power is supplied to a metal heater 43. The metal heater 43 is a metallic resistance element generating a weak heat when receiving power, and it is installed adjacent to the R-thermostat 42. The R-thermostat 42 thus accurately senses a real temperature of the refrigerating compartment even in the case that a peripheral temperature is very cold as can occur during the winter, because a temperature compensation for such a peripheral cold temperature is achieved by the weak heat generated.

A door switch 40 is mounted to one side of the freezing compartment fan motor 41 and the refrigerating compartment fan motor 44. The door switch 40 turns on a first lamp 38 upon the opening of the refrigerating compartment door Dr, and turns on a second lamp 39 upon the opening of the freezing compartment door Df. If the first and second lamps 38 and 39 are turned on, power provided to the fan motors 41 and 44 is cut off by the door switch 40.

If a predetermined defrosting time period occurs as a result of a continuous cooling operation, a synchronous motor M1 of the defrosting timer 31 is driven and power is thus connected to the second terminal a2. Accordingly, power applied from the freezing compartment temperature regulator 30 is provided to the first defrosting heater 34 serially connected to a first temperature fuse 33, as well as to the second defrosting heater 37 serially connected to a second temperature fuse 36. It will be noted that the first bimetal thermostat 32 is connected to the first temperature fuse 33, and the second bimetal thermostat 35 is connected to the second temperature fuse 36.

In a defrosting operation of the refrigerating compartment R, the first defrosting heater 34 heats until the first bimetal thermostat 32 is turned off after a peripheral temperature of the refrigerating compartment evaporator 52 reaches the defrosting release temperature. In a defrosting operation of the freezing compartment F, the second defrosting heater 37 heats until the second bimetal thermostat 35 is turned off after a peripheral temperature of the freezing compartment evaporator 51 reaches the defrosting release temperature.

Figure 5:
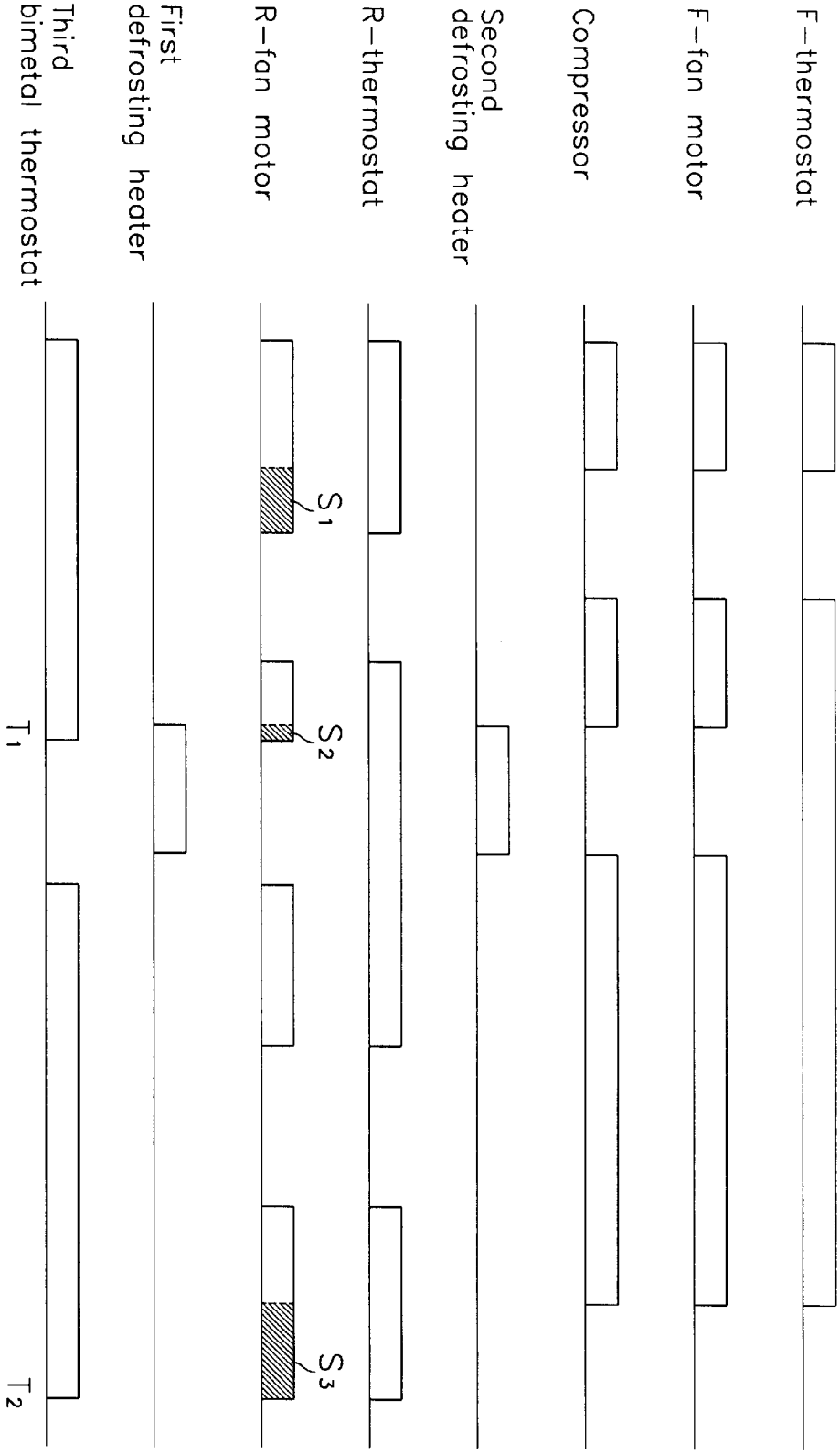
FIG. 5 is a timing chart showing an operation of each part of the refrigerator according to the present invention.

Operations of the operation control apparatus will be described with reference to FIG. 5.

In the case where the freezing compartment F and the refrigerating compartment R are simultaneously cooled, as in an initial operation of the refrigerator, the F-thermostat 30 is turned on, and the R-thermostat 42 is connected to a first terminal b1.

With the F-thermostat 30 turned on, the defrosting timer 31 is connected to the first terminal a1 (no present defrosting operation is assumed), the compressor 47 and the freezing compartment fan motor 41 are driven by a power, and cool air is thus circulated into the freezing compartment F. Also, with the R-thermostat 42 connected to the first terminal b1, the refrigerating compartment fan motor 44 is receiving power from the power input terminal AC and is driven, and cool air generated by the refrigerating compartment evaporator 52 is circulated into the refrigerating compartment R.

After that, as the freezing compartment temperature is lowered below a set temperature, the F-thermostat 30 is turned off to cut off power, so that the compressor 47 and the freezing compartment fan motor 41 are stopped and thus the cooling operation of the freezing compartment is stopped.

At this time, if the refrigerating compartment temperature is higher than a set temperature due (for example) to an opening of the refrigerating compartment door Dr, the R-thermostat 42 is connected to the first terminal b1 and the third bimetal thermostat 49 is at an on-state (that is, a cooling or further cooling operation of the refrigerating compartment is required). Thus, the power input terminal AC continues to provide power to the refrigerating compartment fan motor 44, and the refrigerating compartment fan 44*a* rotates at a predetermined speed. Although the compressor 47 is at the off-state at this time, if the refrigerating compartment fan motor 44 is driven, relatively cool air is provided and circulated into the refrigerating compartment during a predetermined period after the compressor 47 is turned off. Accordingly, a further rising of the refrigerating compartment inside temperature is prevented, and a cooling operation of the refrigerating compartment can be effectively performed.

Then, if the R-thermostat 42 is turned off, power applied to the refrigerating compartment fan motor 44 is cut off, thereby stopping the refrigerating compartment fan motor 44 and stopping the cooling operation of the refrigerating compartment. As stated above, the refrigerating compartment fan motor 44 is thus additionally (but selectively) driven for a predetermined time S1 after the compressor 47 is turned off by the operation of the R-thermostat 42, regardless of the operation of the F-thermostat 30.

In the meantime, if the predetermined defrosting time period occurs while a cooling operation for each compartment is being performed, the defrosting timer 31 is switched to the second terminal a2 by the driving of the synchronous motor M1. The compressor 47 is thus turned off, the first defrosting heater 34 is powered, and thereby frost formed on the refrigerating compartment evaporator 52 is removed. At the same time, the second defrosting heater 37 is also powered, thereby performing a defrosting operation on the freezing compartment evaporator 51. In this way, a defrosting operation starts. The third bimetal thermostat 49 which is adjacent to the first defrosting heater 34 and which is mounted on the refrigerating compartment evaporator 52, is firstly turned off at a timing T1, so that the refrigerating compartment fan motor 44 is stopped. It is desirable that a period S2, wherein the refrigerating compartment fan motor 44 is driven after the defrosting operation, should be set to be relatively short to prevent raising of the refrigerating compartment temperature.

After initiation, a peripheral temperature of the refrigerating compartment evaporator 52 rises due to the heat produced by the first defrosting heater 34, and thus the peripheral temperature reaches a defrosting release temperature. At that temperature, the first bimetal thermostat 32 is turned off, and the first defrosting heater 34 thus does not generate further heat. Also, if the peripheral temperature of the freezing compartment evaporator 51 reaches a defrosting release temperature, the second bimetal thermostat 35 is turned off, and the second defrosting heater 37 is not heated.

If the defrosting operation is finished, the defrosting timer 31 is connected to the first terminal al by a driving of the synchronous motor M1, and the compressor 47 and the freezing compartment fan motor are (again) all driven. In addition, if the compressor 47 is not driven and the first defrosting heater 34 is not heated, and if the surface temperature of the refrigerating compartment evaporator 52 drops to a predetermined temperature about 12° C. below, the third bimetal thermostat 49 is thereby changed to an on-state.

In the case of a cooling operation for the freezing compartment, cool air generated from the freezing compartment evaporator 51 by a driving of the compressor 47 and of the freezing compartment fan motor 41 circulates in the freezing compartment. While the cooling operation of the refrigerating compartment is performed independent of a cooling operation of the freezing compartment, the R-thermostat 42 is connected to the first terminal b1 and the third bimetal thermostat 49 is turned on to drive the refrigerating compartment fan motor 44, thereby performing a cooling operation of the refrigerating compartment.

In this way, if the freezing compartment temperature is lower than a set temperature while performing the cooling operation of each compartment, the F-thermostat 30 is changed to an off-state, and the compressor 47 and the freezing compartment fan motor 41 are stopped.

At this time, if the refrigerating compartment temperature is higher than the refrigerating compartment set temperature, the R-thermostat 42 is turned on. Consequently, power is continuously provided to the refrigerating compartment fan motor 44, and the refrigerating compartment fan 44*a* rotates with a predetermined speed. Accordingly, cool air is circulated into the refrigerating compartment by a rotation of the refrigerating compartment fan 44*a*, and thus a cooling operation of the refrigerating compartment is performed until the R-thermostat 42 is turned off.

As described above, according to the present invention, the refrigerating compartment temperature regulator and the refrigerating compartment fan which are connected in parallel are directly connected to the power input terminal, and thus a cooling operation of the refrigerating compartment can be effectively performed independently of the cooling operation of the freezing compartment.

Accordingly, the present invention additionally drives the refrigerating compartment fan motor if a cooling operation of the refrigerating compartment is required even in the case that a cooling operation of the freezing compartment is finished, and thus effectively prevents a rising of the refrigerating compartment temperature, thereby enhancing an operation efficiency.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An operation control apparatus for a refrigerator which refrigerator includes (a) a freezing compartment evaporator and a freezing compartment fan motor mounted in a freezing compartment, (b) a refrigerating compartment evaporator and a refrigerating compartment fan motor mounted in a refrigerating compartment, and (c) a freezing compartment temperature regulator for setting a freezing compartment temperature to a predetermined temperature and for switching power to the freezing compartment fan motor, (d) a refrigerating compartment temperature regulator for setting a refrigerating compartment temperature to a predetermined temperature and for switching power to the refrigerating compartment fan motor, and (e) a compressor, the operation control apparatus wherein:

the freezing compartment temperature regulator is serially connected to the freezing compartment fan motor, the refrigerating compartment temperature regulator is serially connected to the refrigerating compartment fan motor, the compressor is serially connected to the freezing compartment temperature regulator for operation only when the freezing compartment regulator switches power to the freezing compartment fan motor, (a) the serially connected refrigerating compartment temperature regulator and refrigerating compartment fan motor and (b) the serially connected freezing compartment temperature regulator and freezing compartment fan motor are respectively connected in parallel to an input terminal of a power-supply such that independent activations are provided for the freezing compartment fan motor by the freezing compartment temperature regulator and for the refrigerating compartment fan motor by the refrigerating compartment temperature regulator, and a temperature sensor which senses a temperature of the refrigerating compartment evaporator is connected in series to the refrigerating compartment fan motor to switch power to the refrigerating compartment fan motor when a temperature of the refrigerating compartment evaporator is sufficient for cooling of the refrigerating compartment such that, even when the compressor is not in operation, if the temperature of the refrigerating compartment evaporator is sufficient for cooling of the refrigerating compartment and the refrigerating compartment temperature regulator is switching power to the refrigerating compartment fan motor to provide cooling, the refrigerating compartment fan motor is activated to provide cooling of the refrigerating compartment.

2. An operation control apparatus for a refrigerator as claimed in claim 1, wherein:

the freezing compartment fan motor, the refrigerating compartment temperature regulator, and the refrigerating compartment fan motor are connected in parallel to the compressor.

3. An operation control apparatus for a refrigerator as claimed in claim 1, wherein:

the temperature sensor is a bimetal thermostat mounted adjacent to a defrosting heater mounted on the refrigerating compartment evaporator, and is operated to turn off the refrigerating compartment fan motor after a defrosting operation has started.

* * * * *